United States Patent [19]

Alaspa et al.

[11] 4,423,369

[45] Dec. 27, 1983

[54] INTEGRATED VOLTAGE SUPPLY

[75] Inventors: Allan A. Alaspa; Robert R. Beutler, both of Tempe, Ariz.

[73] Assignee: Motorola, Inc., Schaumburg, Ill.

[21] Appl. No.: 28,948

[22] Filed: Apr. 11, 1979

Related U.S. Application Data

[63] Continuation of Ser. No. 757,169, Jan. 6, 1977, abandoned, which is a continuation of Ser. No. 577,818, May 15, 1975, abandoned.

[51] Int. Cl.[3] ..... G05F 5/00

[52] U.S. Cl. ..... 323/303; 323/274

[58] Field of Search ..... 323/22 R, 22 T, 274, 323/281, 300, 303

[56] References Cited

U.S. PATENT DOCUMENTS

| | | | |
|---|---|---|---|
| 3,031,608 | 4/1962 | Eschen et al. | 323/22 T |
| 3,178,633 | 4/1965 | Slusher et al. | 323/22 T |
| 3,388,318 | 6/1968 | O'Brien | 323/22 T |
| 3,508,084 | 4/1970 | Warner | 323/22 R |
| 3,701,004 | 10/1972 | Tuccinardi et al. | 323/22 Z |
| 3,743,923 | 7/1973 | Steudel | 323/22 R |
| 3,757,200 | 9/1973 | Cohen | 323/22 R |
| 3,983,473 | 9/1976 | Sanderson | 323/22 R |
| 4,005,353 | 1/1977 | Yokoyama | 323/22 R |

OTHER PUBLICATIONS

Wu, "Designing Power Supplies with FETS", EEE, Dec. 1968, vol. 16, No. 12, pp. 68, 69.

*Primary Examiner*—A. D. Pellinen
*Attorney, Agent, or Firm*—Joe E. Barbee

[57] ABSTRACT

A complementary field effect transistor integrable voltage regulator suitable for use in CMOS integrated circuits includes first and second regulator sections coupled together. One regulator section includes a P channel MOSFET and an N channel MOSFET and a resistor, the P channel MOSFET and the resistor being coupled in series between an internal supply conductor and a reference conductor, the N channel MOSFET being connected in parallel therewith and having its gate electrode connected to the junction between the P channel MOSFET and the resistor. The gate electrode of the P channel MOSFET is connected to the output of another regulator, which includes a zener diode and a resistor coupled in series between the reference conductor and another voltage conductor.

3 Claims, 4 Drawing Figures

INTEGRATED VOLTAGE SUPPLY

This is a continuation of application Ser. No. 757,169, filed Jan. 6, 1977 now abandoned, which is a continuation of application Ser. No. 577,818, filed on May 15, 1975 now abandoned.

BACKGROUND OF THE INVENTION

CMOS circuits commonly manufactured in the semiconductor industry have extremely low DC power dissipation. This is often a major reason for selection of CMOS type circuits. Typically, CMOS circuits operate from a single power supply, commonly designated $V_{DD}$ and having a single reference terminal, often designated $V_{SS}$. However, various extraordinary requirements may arise wherein a second supply voltage is required by circuitry in a CMOS integrated circuit chip. It is undesirable to dedicate an external lead of a semiconductor package to provide such an additional voltage conductor, since LSI (large scale integrated) circuits implemented using CMOS technology require dedication of as many of the lead pins as possible to provide inputs and outputs for the integrated circuit. However, known methods of producing a regulated internal voltage generally dissipate a large amount of power, which is extremely undesirable, since a main reason for utilizing CMOS circuitry in the first place is to take advantage of its extremely low power dissipation.

SUMMARY OF THE INVENTION

It is an object of this invention to provide an integrable voltage regulator capable of producing a regulated voltage at predetermined current levels while dissipating very low average power.

It is another object of the invention to provide a CMOS integrable voltage regulator which provides a solution to the above-mentioned problems.

Briefly described, the invention is an integrable voltage regulator circuit including a first voltage regulator connected to a first conductor and to a second conductor and a second voltage regulator circuit coupled between a third voltage conductor and the second voltage conductor including feedback circuit means coupled to the first voltage regulator circuit for receiving a reference signal from the first voltage regulator circuit and causing increased current to flow through the third conductor in response to any increase of voltage of the third conductor. In a preferred embodiment, the first voltage regulator includes a zener diode comprised of a P type and an N type source drain diffusion in a CMOS structure and a resistor. The second voltage regulator circuit includes a P channel MOSFET and an N channel MOSFET, the N channel MOSFET being connected between the second and third voltage conductors and having its gate connected to a junction between the P channel MOSFET and a second resistor, the latter which are coupled in series between the second and third conductors.

DESCRIPTION OF THE INVENTION

Figure 1:
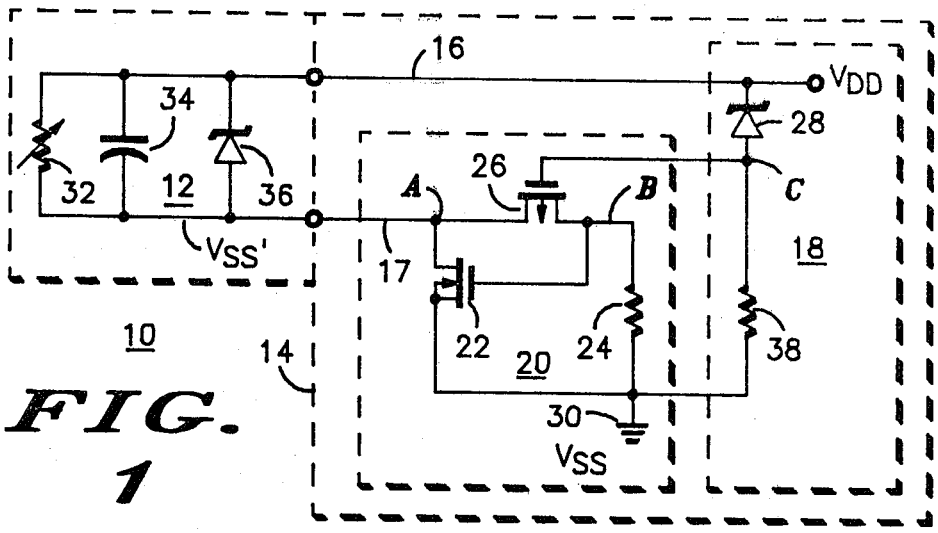
FIG. 1 is a circuit schematic diagram of a presently preferred embodiment of the invention.

FIG. 1 illustrates circuitry 10 which includes regulated voltage supply 14 and circuitry 12. Circuitry 12 includes variable resistor 32, capacitor 34, and zener diode 36 coupled in parallel between voltage conductors 16 and 17, and represents an equivalent circuit of generalized CMOS (complementary MOS field effect transistor) circuitry, wherein variable resistor 32 is the equivalent variable resistance of the generalized CMOS circuit, capacitor 34 is the equivalent capacitance, and zener diode 36 represents an intrinsic parasitic zener diode associated with terminals of known CMOS structures.

Regulated voltage supply circuit 14 is connected between $V_{DD}$ conductor 16 and $V_{SS}$ conductor 30 and operates to generate a regulated voltage $V_{SS}'$ at conductor 17. Regulated voltage supply circuit 14 includes two voltage regulator circuits 20 and 18. Voltage regulator circuit 20 includes N channel MOSFET (metal oxide semiconductor field effect transistor) 22, P channel MOSFET 26, and resistor 24. MOSFET 22 has its drain connected to conductor 17 (i.e., node A) and its source connected to conductor 30 and its gate connected to node B. MOSFET 26 has its source connected to conductor 17, its drain connected to node B and its gate connected to node C, which is the output of voltage regulator circuit 18. Resistor 24 is connected between node B and conductor 30. Regulator 18 includes zener diode 28 and resistor 38. Zener diode 28 has its cathode connected to $V_{DD}$ conductor 16 and its anode connected to node C, and resistor 38 is connected between node C and $V_{SS}$ conductor 30.

Figure 2:
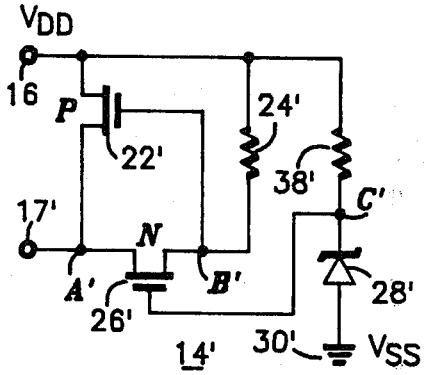
FIG. 2 is a schematic circuit diagram of another embodiment of the invention.

FIG. 2 is an alternative embodiment of the invention similar to the embodiment of FIG. 1. However, the channel types of Channel 22 and 26 have been interchanged and the polarity of the zener diode has been reversed. The same reference numerals, with primes added, have been utilized to indicate the corresponding elements.

The embodiment of FIG. 1, for example, could be used to generate a voltage between $V_{DD}$ and $V_{SS}'$ determined by the breakdown voltage of zener diode 28. However, if it were desired to generate a regulated voltage between $V_{SS}$ and $V_{SS}'$, then the regulator 14' of FIG. 2 could be utilized, wherein the magnitude of the regulated voltage would be determined largely by the breakdown voltage of zener diode 28'.

Figure 4:
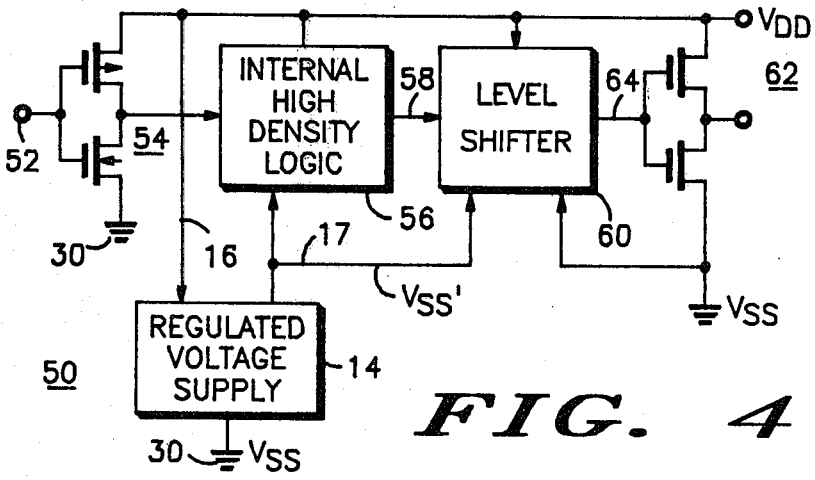
FIG. 4 is a partial schematic diagram illustrating a useful application of the embodiment of FIG. 1.

FIG. 4 illustrates a typical embodiment of the invention in a CMOS integrated circuit which includes regulated voltage supply 14, generalized internal logic Section 56, input level shifter 54, and output level shifter 60, which may incorporate driver 62. The internal logic section 56 operates between $V_{DD}$ and $V_{SS}'$. Input buffer 54 operates between $V_{DD}$ and $V_{SS}$. The output circuitry also operates between $V_{DD}$ and $V_{SS}$.

A preferred embodiment of the invention provides an internal supply voltage to provide operating power to internal circuitry 56 which is fabricated with a collapsed guard ring CMOS structure. One known collapsed guard ring CMOS manufacturing process requires that the operating voltage applied to such internal circuitry be less than approximately 6 volts. It is desirable, however, that the range of applied voltages for $V_{DD}$ with respect to $V_{SS}$ externally applied to an integrated circuit range from approximately 3–18 volts.

The combination of a collapsed guard ring internal section with peripheral, full-voltage non-collapsed guard ring type input-output circuit sections affords the benefit of a conventional high voltage CMOS section with the high density and low cost of collapsed guard ring type CMOS circuits. For a more complete description of collapsed and non-collapsed guard ring structures, see copending patent application Ser. No. 577,968, filed on even date herewith and now U.S. Pat. No. 4,006,491 by the same inventors. Especially see FIG. 3 and pages 4 and 5 of the specification thereof. Also see the 1975 IEEE Intercon Conference Record, presented at the Institute of Electrical and Electronics Engineers International Convention and Exposition, Apr. 8–10, 1975, New York, Session 18 entitled "Configurations and Characteristics of Future Digital Logic Devices", pages 3 and 4 in FIGS. 4, 5 and 7.

The operation of the circuitry in FIG. 1 is as follows. First, if $V_{DD}$ is less than $V_Z$, the breakdown voltage of zener diode 28, the gate-to-source voltage $V_{GS}$ of MOSFET 26 is equal to $V_{SS}'$, the voltage on node 17, since no current flows through resistor 38; therefore node C is at ground potential, i.e., at $V_{SS}$ volts. When $V_{SS}'$ is less than $V_{TP}$, the threshold voltage of P channel MOSFET 26, then both N channel MOSFET 22 and P channel MOSFET 26 are off. However, when $V_{SS'}$ exceeds $V_{TP}$, P channel MOSFET 26 in conjunction with resistor 24 operates as a source follower, so that the voltage at node B becomes $R1/R1+R_P$, where $R_P$ is the linear resistance of P channel MOSFET 26 and R1 is the resistance of resistor 24. If R1 is very large in magnitude, for example, 200 kilohms, $V_B$, the voltage at node B, will closely follow $V_{SS}'$ if $V_{SS}'$ is greater than $V_{TP}$. If $V_{SS}'$ increases such that $V_B$ increases to the point where $V_B$ is greater than $V_{TN}$, the threshold voltage of N channel MOSFET 22, N channel MOSFET 22 will start to turn on and will pull $V_{SS}'$ toward ground until $V_{SS}'$ is equal to the larger of $V_{TN}$ or $V_{TP}$.

If $V_{DD}$ is greater than $V_Z$, then the voltage at node C, $V_C$, is equal to $V_{DD} - V_Z$, where $V_Z$ is the breakdown voltage of zener diode 28. The value of $V_{SS}'$ required to turn P channel MOSFET 26 on is then $V_{DD}-V_Z+V_{TP}$. Further increases in $V_{SS}'$ will result in $V_B$ rising to $V_{TN}$, at which point N channel MOSFET 22 is turned on. The geometry of MOSFET 22 is advantageously chosen to provide a sufficiently great current carrying capability to provide the desired degree of regulation of $V_{SS}'$ and still to supply all the current that is required by circuit 12.

Figure 3:
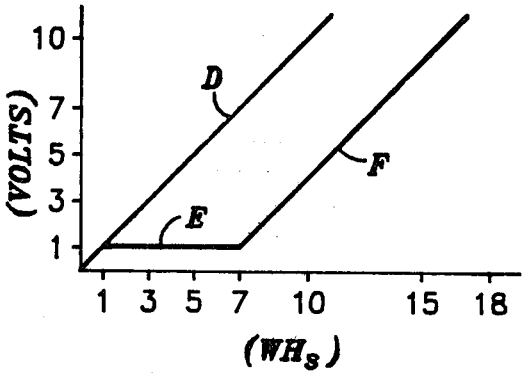
FIG. 3 is a graph useful in illustrating the operation of the embodiment of FIG. 1.

The graph in FIG. 3 illustrates a typical voltage characteristic of regulator circuit 14 of FIG. 1. Segment D represents the applied voltage $V_{DD}$. Segment E represents the value of $V_{SS}'$ when $V_{DD}$ is less than $V_Z$, the breakdown voltage of zener diode 28. In this case $V_{SS}'$ is equal to the greater of $V_{TP}$ or $V_{TN}$, the threshold voltage of MOSFETs 26 and 22, respectively. Segment F is the value of $V_{SS}'$ if $V_{DD}$ is greater than $V_Z$. Note that the voltage drop between $V_{SS}'$ and $V_{DD}$ is constant, regardless of the value of $V_{DD}$.

Those skilled in the art will recognize that a major advantage of CMOS integrated circuitry is its very low power dissipation. Utilization of a regulated voltage supply 14 in a CMOS circuit to provide an internal power source is consistant with this advantage, since resistor 38 can be made very large, for example, greater than 100–200 kilohms, to minimize power dissipation. For example, if the breakdown voltage of zener diode 28 is approximately 6.8 volts, and $V_{DD}$ is 18 volts and the power dissipation through resistor 38 is only approximately 630 microwatts. It should be noted that the value of capacitor 34 should be large enough to assure filtering of transient current spikes during switching the CMOS circuitry represented by equivalent circuit 12. MOSFET 22 must be designed to be capable of supplying the maximum current drain of the internal circuitry, represented by variable resistor 32; that current will be the sum of the leakage current and the dynamic power dissipation current dissipated by circuit 12.

The above described circuit therefore offers relatively low dynamic impedance, very low power dissipation, and permits use of the high density collapsed guard ring CMOS internal circuitry even though more conventional, higher magnitude external power supplies compatable with older forms of CMOS integrated circuitry are utilized. Those skilled in the art will also recognize that the dynamic power dissipation of the internal circuitry is substantially reduced utilizing regulated voltage supply circuit 14.

It should be noted that the value of resistor 24 can also be as high as 200 kilohms. The value of resistor 38 needs to be low enough however, that sufficient current flows through zener diode 28 to get it to operate at the knee part of its reverse breakdown characteristics.

What is claimed is :

1. An integrated voltage supply coupled to a first and a second voltage terminal and providing a first and a second output, comprising:

A zener diode having an anode and a cathode, the cathode being coupled to the first voltage terminal; a first resistor coupled between the anode of the zener diode and the second voltage terminal, and forming a node between the first resistor and the anode of the zener diode; a first field effect transistor having a first and a second electrode and a gate electrode, the gate electrode being coupled to the node; a second resistor coupled between the first electrode of the first field effect transistor and the second voltage terminal; and a second field effect transistor having a first and a second electrode and a gate electrode, the gate electrode being coupled to the first electrode of the first field effect transistor, the first electrode of the second field effect transistor being coupled to the second voltage terminal, the second electrodes of the first and second field effect transistors being coupled together and forming the second output, and the first voltage terminal also serving as the first output.

2. The integrated voltage supply of claim 1 wherein the first field effect transistor is a P-channel transistor and the second field effect transistor is an N-channel transistor.

3. The integrated voltage supply of claim 1 wherein the second resistor is of a higher ohmic value than the first resistor.

* * * * *